US006062930A

United States Patent [19]

Smith

[11] Patent Number: 6,062,930

[45] Date of Patent: May 16, 2000

[54] MULTIPURPOSE RECREATIONAL MAT

[76] Inventor: Roger A. Smith, 243 Via Promesa, Paso Robles, Calif. 93446

[21] Appl. No.: 09/176,307

[22] Filed: Oct. 22, 1998

Related U.S. Application Data

[60] Provisional application No. 60/069,115, Dec. 9, 1997.

[51] Int. Cl.[7] ..... B63C 9/08

[52] U.S. Cl. ..... 441/129; 441/125

[58] Field of Search ..... 441/80, 88, 106–119, 441/125–131; 5/417–420

[56] References Cited

U.S. PATENT DOCUMENTS

| | | | |
|---|---|---|---|
| 1,742,104 | 12/1929 | Skoldberg | 441/111 |
| 4,275,473 | 6/1981 | Poirer . | |
| 4,654,907 | 4/1987 | Haugaard . | |
| 4,662,851 | 5/1987 | Foster . | |
| 5,265,292 | 11/1993 | Underell . | |
| 5,314,395 | 5/1994 | Ciolino . | |
| 5,384,923 | 1/1995 | Hwang et al. | 5/419 |
| 5,439,405 | 8/1995 | Storey et al. | 441/126 |

FOREIGN PATENT DOCUMENTS 3321413 12/1984 Germany .

*Primary Examiner*—Ed Swinehart
*Attorney, Agent, or Firm*—Richard C. Litman

[57] ABSTRACT

A multipurpose recreational mat for primary use in water and a secondary use on an inflexible surface. The mat comprises three flotation bodies preferably made of a closed cell polyurethane foam. A waterproof unitary cover surrounds the flotation bodies formed by a specific process. A strap is provided for use in carrying or storage and while an individual is sitting on the mat while floating in the water. At least one grommet in each flotation body cover permits drainage of any water entering through the stitched seams.

8 Claims, 2 Drawing Sheets

MULTIPURPOSE RECREATIONAL MAT

CROSS-REFERENCE TO RELATED APPLICATION

This application claims the benefit of U.S. Provisional Patent Application Ser. No. 60/069,115, filed Dec. 9, 1997.

BACKGROUND OF THE INVENTION

1. Field of the Invention

The present invention relates to a recreational mat that is floatable and foldable.

2. Description of Related Art

The relevant art of interest describes various swim floats and mattresses. The relevant art will be discussed in the order of perceived relevance to the present invention.

Inflatable swim floats are known in the art. However, inflatable floats are prone to puncture, thus rendering them useless for their intended purpose. Inflatable floats are also often bulky and awkward to store when void of air.

U.S. Pat. No. 4,654,907, issued on Apr. 7, 1987, to Bradley R. Haugaard describes a cloth covered folding recreation chair-pad which may be folded out into a flat pad and folded up into a luggage piece with a carrying handle by hook and loop patches. The chair-pad is formed from three closed compartments and a covered extension. Each compartment is secured by three doubled cloth hinges and grommets. The first end compartment has a foam pad and the other two compartments contain a foam pad and a plywood backing sheet. The plywood backed compartments form an A-frame structure. The chair-pad is distinguishable for its cloth covered non-floating structure.

U.S. Pat. No. 5,314,395, issued on May 24, 1994, to Peter A. Ciolino describes an aquatic rehabilitation platform for patients to support them in a fixed position in water. The platform is formed from three sections. The upper section is elevated and may have two side straps or attachable pontoons of gas-filled polymers. The seat section has strapping flaps for the legs. Between the upper section and the seat section, a lumbrosacral support pad is positioned. The lower section is bent downwards to form a reclining chair. The aquatic platform is distinguishable for its limited inflexible structure with restraining straps and pontoons.

U.S. Pat. No. 5,265,292, issued on Nov. 30, 1993, to Raymond R. Underell describes a foldable rectangular cloth lounge cushion having four square sections separated by cloth hinges. Two cushions on one end have plywood centers sandwiched between foam material which is fused to the cloth cover. These rigid sections form a seatback. Between the second and third sections, a cloth carrying strap is attached to form a folded condition of the lounge cushion for carrying or storage. The lounge cushion is distinguishable for its non-floating structure.

U.S. Pat. No. 4,275,473, issued on Jun. 30, 1981, to Jean B. Poirier describes a floating mattress constructed of a plurality of light-weight, relatively rigid, buoyant blocks of substantially equal length. The blocks are held in side-by-side spaced relation by an outer skin. The longitudinal edges of the blocks may be beveled so as to allow ease of rolling and folding of the mattress. Finally, a handle may be attached to one or both of the ends of the mattress. The mattress is distinguishable because the plurality of blocks are excessive in numbering at least 12 blocks and up to 15 blocks and could not possibly be used as a floating chair as in the present invention.

U.S. Pat. No. 4,662,851, issued on May 5, 1987, to John K. Foster shows a swim float either rectangular or fish-shaped and constructed of a plurality (3 or 4) of hinged sections with an aperture on one end for a handle. Two core blocks of each section are hingedly interconnected by upper and lower flexible layers. The sidewalls of adjacent sections are bevelled so that the skin of a user will not be pinched therebetween. The swim float is distinguishable for its required hinging structure of two core blocks per section.

German Patent Publication No. DE 3321-413A, published Dec. 12, 1984, for Paul Kusenberg describes a floating life-saving sled for waterborne casualties having a two-part body support hinged to a headrest to either swing apart or be lockable together. The outside edges of the headrest and swingable sections have floating fenders. A centered handle and a pair of towing eyes are provided on the headrest, and a pair of handles are provided at the ends of the swingable sections. The publication is distinguishable for its significant structural differences from the present invention.

None of the above inventions and patents, taken either singly or in combination, is seen to describe the instant invention as claimed.

SUMMARY OF THE INVENTION

The present invention is a recreational mat which comprises a plurality of flotation bodies positioned in a side-by-side arrangement, and an exterior cover made of a unitary piece of material. The exterior cover is folded over to surround the flotation bodies. The exterior cover is stitched around the flotation bodies, thereby fixedly keeping the flotation bodies in their side-by-side arrangement. The recreational mat also includes a strap attached to the exterior cover. The strap includes two free ends and include a fastener attached to the free ends, thereby allowing the free ends to removably connect to one another.

The flotation bodies are preferably made of a material that is buoyant. An example of such floatable material is a closed cell polyurethane foam and the like. The exterior cover is preferably made of a material that is water resistant and durable, such as nylon and the like.

The mat can be used for a variety of purposes. For example, the mat can be used as a raft, an exercise mat, a sleeping pad, and a reclining chair.

Accordingly, it is a principal object of the invention to provide a floatable raft and chair.

It is another object of the invention to provide an exercise mat which is convenient to clean and to store in a folded condition.

It is a further object of the invention to provide a sleeping mat convertible to a reclining chair.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a recreational mat 10 in which a user can use for various activities. For example, the user can use it as an exercise, a reclining chair or a sleeping mat 10 to keep the person off the ground. The user can also use the mat 10 as a flotation device to either lie down prone or in a supine position on the mat 10 like a traditional raft, or the user can opt to be in a sitting position.

Figure 1:
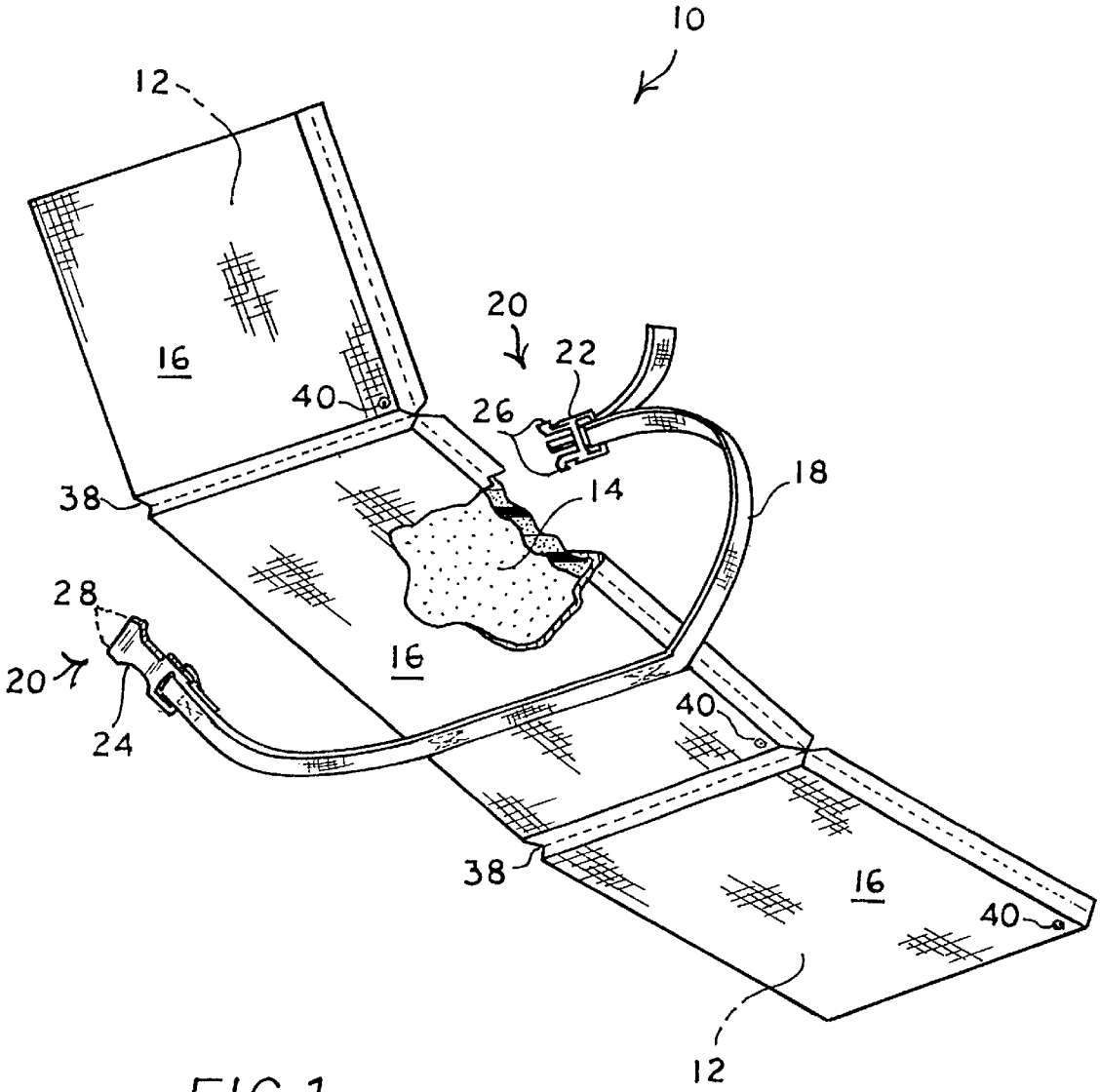
FIG. 1 is a perspective, partially fragmented bottom view of an embodiment of a multipurpose recreational mat according to the present invention.

Referring to FIG. 1 as viewed from underneath to better illustrate the strap attachment, the recreational mat 10 comprises a plurality of covered flotation bodies 12 and 14, e.g., three, positioned linearly in a side-by-side arrangement. The two outer covered flotation bodies 12, preferably are rectangular shaped having exemplary dimensions of approximately 15"×20"×1". The remaining intermediate or inner covered flotation body 14 is preferably rectangular shaped having exemplary dimensions of approximately 24"×20"×1".

The flotation bodies 12 and 14 are made of a buoyant material in order to make the mat 10 floatable in a body of water 36 (FIGS. 3 and 4) as a raft. The buoyant material is preferably a material such as a closed cell polyurethane foam. Closed cell poly-urethane foam is water resistant and has air trapped within the cells which gives the material its buoyant characteristic.

The mat 10 has a cover 16 which is preferably made of a flexible water resistant material such as waterproofed nylon fabric and the like. This serves three purposes. Firstly, the material prevents water from coming into contact with the polyurethane foam. Secondly, the material is sewable. Thirdly, the material makes the mat 10 easy to clean.

The cover 16 is a unitary piece of material and formed in a specific manner to secure the buoyancy of the mat 10. The flotation bodies 12, 14, which are arranged in a linear fashion, are lined up on one-half of the cover 16, thus leaving the other half open. The open half is folded over to cover the exposed portions of the flotation bodies 12, 14. The perimeter of the cover 16 is stitched together with waterproof thread and the gaps 38 between the flotation bodies 12, 14 are stitched together to form articulating gaps, thereby protecting the flotation bodies in their linear side-by-side arrangement from absorbing any water and to enable the articulation of the segments to form seats.

The mat 10 further comprises a strap 18 attached to the cover 16 on the bottom of inner or intermediate flotation body cover 16. The strap 16 includes two free ends with a plastic fastening device or buckle 20 attached to the free ends. The buckle 20 has a male element 22 which is inserted into a female element 24. The locking arrangement includes a pair of collapsible wedges 26 along the sides of the male element 22. The female element 24 includes a pair of catches 32 (hidden) along the sides of the receptacle. When the male element 22 is inserted into the female element 24, the wedges 26 couple with the catches 32, thereby fixedly locking the male element 22 within the female element 24. To remove the male element 22, the wedges 26 are collapsed inwardly to decouple the wedges from the catches 28, thereby freeing the male element 22 from the female element 24. Thus, the buckle 20 can quickly be buckled and unbuckled in the event of an emergency.

Figure 4:
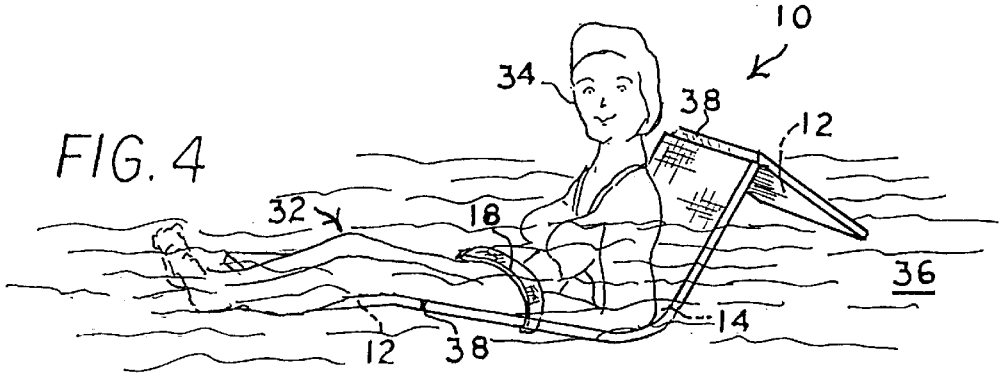
FIG. 4 is an environmental view of the FIG. 1 embodiment used as a float with a woman in a seated position.

In the preferred embodiment of three flotation bodies 12, 14, the strap 18 is preferably attached to the cover 16 enclosing the inner flotation body 14 so that the strap 18 can be used as a seat belt when a user employs the mat 10 in a seated position, as shown in FIG. 4. It is within the ambit of the present invention that the mat 10 can be used on a horizontal surface as a horizontal lounging mat or a reclining chair.

It has found beneficial to add 0.5 in. diameter drain grommets 40 in each corner of the three flotation bodies 12, 14 for drainage of any water which may enter the mat 10 through the fabric's seams.

Figure 2:
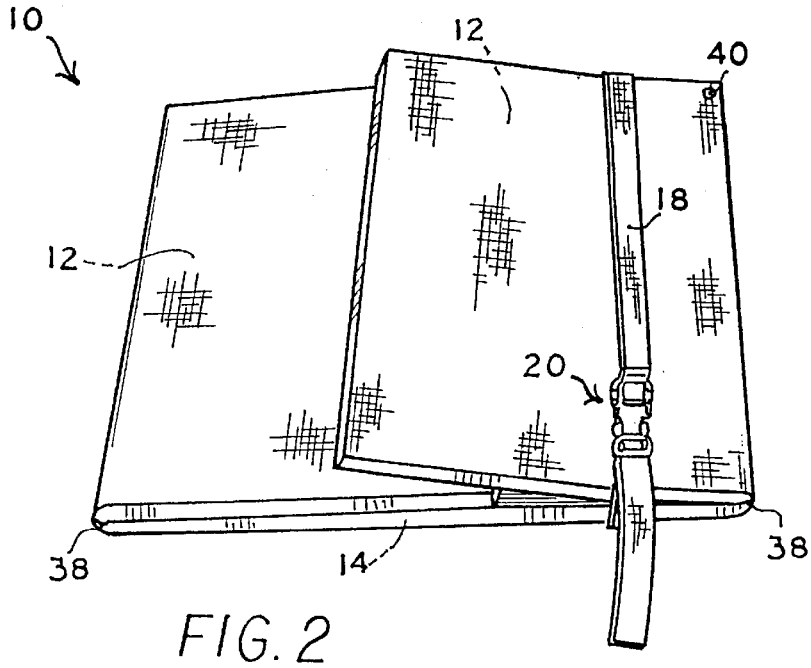
FIG. 2 is a perspective view of the FIG. 1 embodiment in a folded state.

Referring to FIG. 2, the mat 10 is shown in a carrying or storage mode. The mat 10 is folded over along the stitching of the flotation body gaps 38. The strap 18 surrounds the folded mat 10 and the free ends are fastened to each other by the buckle 20.

Figure 3:
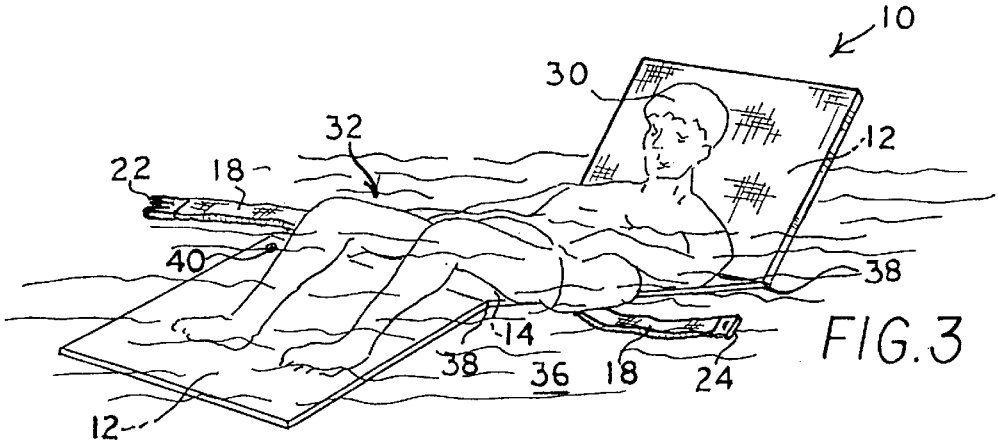
FIG. 3 is an environmental view of the FIG. 1 embodiment used as a float with a man in a supine position.

Referring to FIGS. 3 and 4, the mat 10 is shown in use as a flotation device. FIG. 3 illustrates a man 30 in a supine position on the mat 10 used as a raft with the head lifted up by decreasing the weight on the outer buoyant body 12. The legs 32 are draped over the other buoyant body 12 and a portion of the inner buoyant body 14 to permit either the leg position shown or a horizontal leg position by shifting the body position vis-a-vis the mat 10. The man 30 is shown with most of his body immersed with the strap 18 unlatched if preferred or latched under the mat 10 (not shown).

FIG. 4 illustrates a woman 34 floating in a seated position. The strap 18 is fastened together to aid in stabilizing the woman 34 in the seated position. By shifting the body position to present the legs 32 beyond the outer buoyant body 12 at one end, the opposite end's buoyant body 12 rises to form a seat. Since the inner buoyant body 14 is longer in length than the outer buoyant bodies 12, the woman 34 can bend the inner buoyant body 14 to form the depicted seat. In this situation, the woman 34 is securely held in a sitting position with her head above the water 36 and not be dislodged by rough water. Thus, the floating mat 10 can be readily manipulated to form the desired configuration in the water 36 by shifting one's body weight. The configuration of the mat 10 shown in FIG. 4 can also be utilized on a flat surface such as a sandy beach as a reclining chair.

It is to be understood that the present invention is not limited to the sole embodiment described above, but encompasses any and all embodiments within the scope of the following claims. For example, the exterior cover 14 can also include a plurality of pockets (not shown) sewn into the exterior of the cover 14 for storage of various items.

I claim:

1. A multipurpose recreational mat comprising:

three flat rectangular flotation bodies arranged in a line, wherein two outer bodies abut an intermediate body;

a waterproof cover made of a unitary piece of material and wherein said cover is folded over to surround said flotation bodies;

wherein said cover is stitched around said flotation bodies with waterproof thread to form articulating gaps between said flotation bodies; and a waterproof strap attached to said cover on a bottom surface of the intermediate flotation body, said strap including a quick release fastening device;

whereby said multipurpose recreational mat can be utilized as a horizontal raft, a raft having a seat, an exercise mat, a sleeping pad, and a reclining chair.

2. The multipurpose recreational mat according to claim 1, wherein said three flotation bodies have a size difference, wherein the intermediate flotation body is longer than the outer flotation bodies, said two outer flotation bodies having equal lengths.

3. The multipurpose recreational mat according to claim 1, wherein said flotation bodies are made of polyurethane closed cell foam.

4. The multipurpose recreational mat according to claim 1, wherein said fastening device is a buckle with male and female quick disconnect elements, for quick connection and quick disconnection.

5. The multipurpose recreational mat according to claim 1, wherein said two outer flotation bodies have dimensions of approximately 15"×20"×1" and the intermediate flotation body has dimensions of approximately 24"×20"×1", wherein said three flotation bodies are linearly arranged with the 20" sides in a side-by-side arrangement.

6. The multipurpose recreational mat according to claim 1, wherein said gaps between flotation bodies permit the articulation of the flotation bodies to form a raft seat and a reclining chair.

7. The multipurpose recreational mat according to claim 1, wherein said waterproof strap and quick release fastening device are so dimensioned and configured as to facilitate the bundling of said multipurpose recreational mat for purposes of storage and carrying.

8. The multipurpose recreational mat according to claim 1, including at least one grommet in each flotation body's cover for drainage of water entering through any stitching.

* * * * *